United States Patent [19]

Belter

[11] Patent Number: 4,660,907

[45] Date of Patent: Apr. 28, 1987

[54] EMI FILTER CONNECTOR BLOCK

[75] Inventor: Robert E. Belter, Carlsbad, Calif.

[73] Assignee: Kyocera International, Inc., San Diego, Calif.

[21] Appl. No.: 746,744

[22] Filed: Jun. 20, 1985

[51] Int. Cl.[4] ..... H01R 13/66

[52] U.S. Cl. ..... 339/14 R; 339/147 R

[58] Field of Search ..... 339/14 R, 143 R, 147 R, 339/147 P; 333/182, 183

[56] References Cited

U.S. PATENT DOCUMENTS

| | | | |
|---|---|---|---|
| 2,973,490 | 2/1961 | Schlicke | 333/182 |
| 4,126,370 | 11/1978 | Nijman | 333/183 |
| 4,212,510 | 7/1980 | Ritchie et al. | 339/147 R |

*Primary Examiner*—John McQuade

*Attorney, Agent, or Firm*—Spensley Horn Jubas & Lubitz

[57] ABSTRACT

A multiple pin connector comprising a pin-support body, a filter block, a ground plane, and a dielectric retainer block, through which a plurality of pin contacts extend in a parallel, space the part alignment for engaging complementarily positioned contacts on meeting conductors. The ground plane includes flanges extending around opposed edges of the filter block. The filter block is formed to have a recess therein adjacent each pin location and extending therefrom to an edge of the filter block proximate to the flange of the ground plane. A chip capacitors having a capacitance value appropriate to a desired level of electromagnetic interference protection is inserted in each recess of the filter block. Electrical connections are maintained between the pin contacts and the individual chip capacitors, and the individual chip capacitors and the flanges of the ground plane, by means of solder bridges appropriately disposed. Alternatively, the chip capacitors may be individually soldered to eyelets through which the pins may be placed. In a further embodiment, the flange of the ground plane is utilized as a spring member to retain the chip capacitor within the recess and maintain a electrical contact of the chip capacitor to the pin or eyelet. Each individual chip capacitor may be readily removed and replaced, individually, to vary the degree of electromagnetic interference protection or to replace a faulty chip capacitor.

9 Claims, 7 Drawing Figures

EMI FILTER CONNECTOR BLOCK

BACKGROUND OF THE INVENTION

1. Field of Invention

This invention relates generally to electrical connector assemblies and, more particularly, to connector assemblies providing filtering to minimize electro-magnetic interferences.

2. Description of Related Art

In numerous applications, such as in the computer field, long, unshielded cable runs are often susceptible to picking up extraneous signals where they enter a shielded housing. Filters for such connectors, typically located at the interface through which such cables enter such housings, are known in the art and typically utilize the connector shell for a ground return and include capacitor filters connected between the connector and the connector shell. Typical among the known types of connector filter assemblies are those shown in U.S. Pat. Nos. 3,546,638 to Park, 3,961,295 to Hollyday, et al., 4,079,343 to Nijman, 4,187,481 to Boutros, and 4,222,626 to Hollyday, et al. Each of these patents teaches the construction of a filter which completely surrounds each pin of the connector. Typically, these filters are formed as a sandwich of plate elements separated by a dielectric member. As may be seen by a review of these patents, each of the constructions is relatively complex.

U.S. Pat. No. 3,538,464 to Walsh teaches a similar interference filter construction. However, Walsh discloses a multiple pin connecter wherein the conductive plates and the dielectric plate members are formed as sheets having a plurality of conductive and nonconductive areas, each provided with an interior hole through which the contact pin of the connector is passed. Appropriate contact is made between the pin and the interior surface of alternate conducting layers, with the exterior surface of the interleaved layers placed in electrical contact with the conductor shell. A further variation on this stacked, multiple pin connector approach is found in U.S. Pat. No. 4,144,509 to Boutros.

In addition to the complexity of design of the above-listed patents, if one of the pins of a multiple pin connector is found to have a faulty interference filter, significant effort is generally required to disassemble such a multiple pin connector in order to repair the faulty capacitor. Often the labor intensive costs associated with affecting such repairs have prompted users of such multiple pin filtered connectors to discard the entire connector and replace it with a new, fault-free multiple pin connector.

SUMMARY OF THE INVENTION

It is an object of this invention to provide a multiple pin connector which provides a significant amount of electro-magnetic interference protection together with minimal cross talk between connector pins.

It is another object of this invention to provide a multiple pin connector having significant surge protection.

A further object of this invention is to provide a multiple pin filter connector wherein the filter elements associated with each pin of the connector are individually replacable.

Yet another object of the present invention is to provide a multiple pin filter connector having minimal size and significantly reduced fabrication cost.

These objects are obtained by providing a connector body, formed of a dielectric material, having a plurality of holes therein through which a like plurality of connector pins may be inserted. A second dielectric plate, having a like plurality of holes similarly distributed, is formed to have a like plurality of recesses, each adapted to receive a chip capacitor similar to those well known in the art. Each of the chip receiving recesses is formed such that one end of a chip therewithin is in proximity to a pin passing through its associated feed-through hole, while the other end of the chip is in proximity to a ground plane electrically communicating with each such chip. An additional dielectric plate, having a like plurality of feed-through holes appropriately distributed, is placed over the connector pins such that the chip bearing dielectric plate and the ground plane are sandwiched against the dielectric connector body. A conductive connector shell may be included to surround the periphery of the connector such that the conductive shell is in electrical contact with the ground plane. Alternatively, one of the feed-through connector pins may be utilized in direct contact with the ground plane as a ground connection. The chip capacitors may be retained in their recesses by soldering one end of the chip to the connector pin and the other end of the chip to the ground plane, or, alternatively, by soldering one end of the chip to an eyelet accepting the feedthrough connector pin and the other end of the chip to the ground plane, or, alternatively, by retaining the chip in contact with both the pin and the ground plane by a spring action of a flange formed on the ground plane.

As may readily be observed from the detailed description of the perferred and alternate embodiments set forth below, a multiple pin connector in accordance with the present invention may be readily disassembled by removing the connector shell, enabling the connector body and the dielectric cover plate to be separated, providing access to each of the ceramic chips which may be readily unsoldered or removed from their respective spring mounting positions and replaced.

The foregoing and other objects, features and advantages will be apparent from the following more particular description of a preferred and alternate embodiments hereof, as illustrated in the accompanying drawings.

DESCRIPTION OF THE PREFERRED EMBODIMENT

Figure 1:
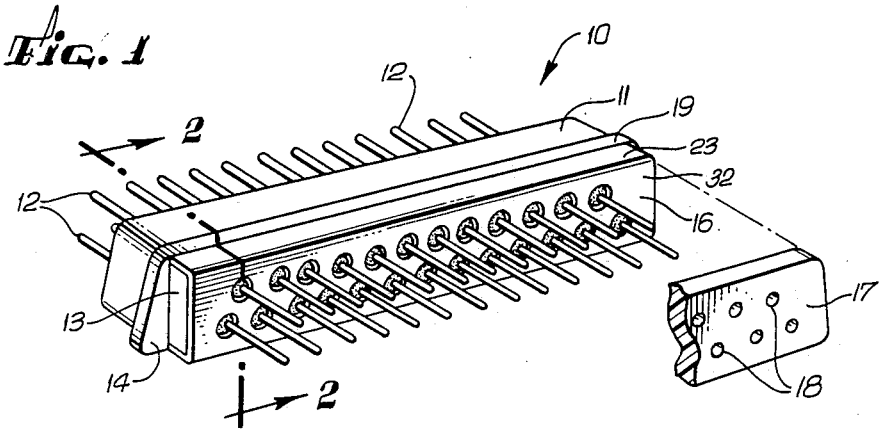
FIG. 1 is a perspective, partially fragmented view of a multi-pin connector in accordance with the present invention.

Referring first to FIG. 1, a typical mutliple-pin connector is indicated generally at 10. When fabricated in accordance with the present invention, the multiple-pin connector 10 is comprised of a pin-support body 11, formed of dielectric material, through which a plurality of conductor pins 12 having their longitudinal axes substantially in alignment may be inserted, a filter block 13, having a plurality of holes there through distributed in a pattern corresponding to the placement of pins 12, abutted against a first surface 14 of the pin-support body 11, a ground plane 16, also having a plurality of holes distributed to enable the pins 12 to pass therethrough without electrical contact, and a dielectric retaining block 17, formed to have a plurality of holes 18 therethrough aligned with and frictionally accepting the pins 12. The dielectric retaining block 17 may be retained to the pins support body 11 by a metalic shell (not shown) around the periphery formed by a flange 19, or alternatively, the dielectric retaining block 17 may be formed to have extensions (not shown) which may be mechanically coupled to the flange 19 of the pin-support body 11.

Figure 2:
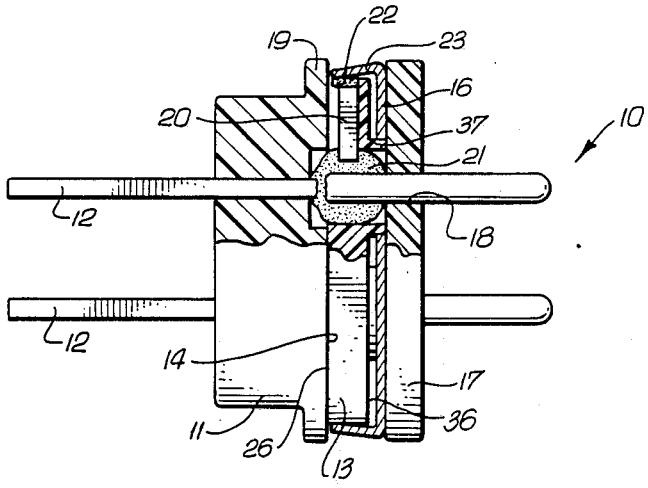
FIG. 2 is a cross-sectional view through the multi-pin connector taken through section 2—2 of FIG. 1.

Referring next to FIG. 2, each of the pins 12 passing through the pin-support body 11, the filter block 13, the ground plane 16 and the dielectric retaining block 17 has a chip capacitor element 20 associated therewith. As will be discussed more fully below, the chip capacitors 20 are situated within cavities formed in the filter block 13. One electrical terminal of each chip capacitor 20 is coupled to a respective one of the pins 12 by a soldering bead 21. The other electrical terminal of each chip capacitor 20 is coupled by a soldering bead 22 to a flange 23 formed on the ground plane 16.

Assembly of the multiple pin connector 10 may be accomplished by inserting the appropriate number of pins 12 through the holes of the pin-support body 11, the filter block 13 and the ground plane 16. The pin-support body 11 may then be moved leftwardly in FIG. 2 with respect to the filter block 13 so that the filter chip capacitors 20 may be inserted in their cavities within the filter block 13 and so that the soldering beads 21 and 22 may be formed. When all such chip capacitors 20 have been soldered, the pin-support body 11 may be moved rightwardly, according to FIG. 2, to abut the filter block 13, and the dielectric retaining block 17 may be placed over the rightward ends of the pins 12 and then slid leftwardly in FIG. 2 to abut against the ground plane 16.

Figure 3:
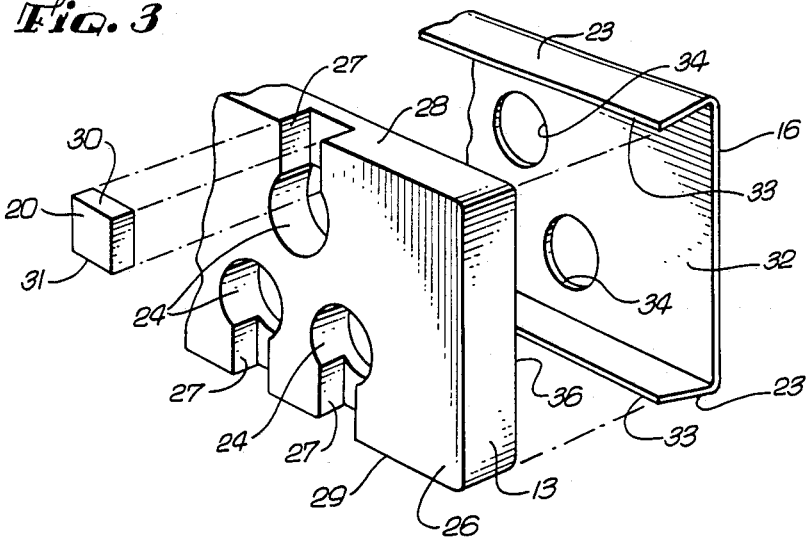
FIG. 3 is an exploded fragmentary perspective of a ground plane and capacitor retaining element in accordance with the present invention.

Referring next to FIG. 3, the filter block 13 may be observed to have a plurality of holes 24 formed therethrough from a surface 26 which abuts the first surface 14 of the pin-support body 11 when the multiple pin connector 10 is assembled. Each of the holes 24 has a recess 27 formed in the surface 26 so as to extend from the hole 24 to an edge 28, 29 of the filter block 13. Each of the recesses 27 is adapted to accept and enclose a chip capacitor 20 of a type readily commercially available. Such chip capacitors 20 are typically fabricated to have a substantially planar rectangular form, with a pair of electrical terminals 30, 31 disposed along opposing edges of the rectangle. When the chip capacitor 20 is installed in the recess 27 during assembly, it is oriented so that the electrical terminals 30 and 31 are proximate to the edges 28, 29 and the hole 24, respectively.

The ground plane 16, formed of a conductive material, is shaped into a channel having a pair of flanges 23 extending linearly substantially the length of the filter block 13. The dimension of each flange 23 from a web surface 32 of the ground plane to a free edge 33 of the flange 23 is substantially equal to the thickness of the filter block 13 taken in a direction of the axial extent of the pins 12. A plurality of holes 34 are formed through the web surface 32 of the ground plane 16 in a pattern matching the placement of the holes 24 through the filter block 13. Each of the holes 34 has a diameter greater than the diameter of the holes 24.

Figure 4:
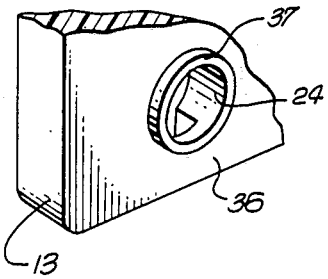
FIG. 4 is a fragmentary perspective of a reverse side of the capacitor retaining element of FIG. 3.

Referring next to FIG. 4, there is illustrated a portion of the filter block 13, showing primarily a portion of an obverse surface 36, opposed to the aforementioned surface 26, encompassing one of the holes 24. During fabrication of the filter block 13, the surface 36 is formed to include a flange 37 surrounding each of the holes 24. The flange 37 is formed as a right circular angular cylinder having an inner diameter equal to that of the hole 24 and an outer diameter substantially equivalent to, but less than, the diameter of the hole 34 through the ground plane 16 such that, when assembled, the flange 37 extends through the hole 34 of the ground plane 16, thereby precluding direct electrical contact between a pin 12 passing through the hole 24 and the ground plane 16.

Referring next to FIGS. 1 through 4, inclusive, it may be seen that an appropriate selection of the capacitance value associated with each of the chip capacitors 20, during assembly of the multiple pin connector 10, can provide the desired measure of protection against externally caused electromagnetic interference. Moreover, it may be noted that the degree of protection against electromagnetic intereferences afforded to each of the pins 12 may be varied among the several pins 12 by selecting chip capacitors 20 having differing values of capacitance. In each case, it should be noted that the individual chip capacitors 20 may be individually replaced in the event that a particular pin 12 is determined to require a greater or lesser degree of protection against electromagnetic interferences, or in the case where the individual chip capacitor 20 has been determined to be faulty.

Figure 5:
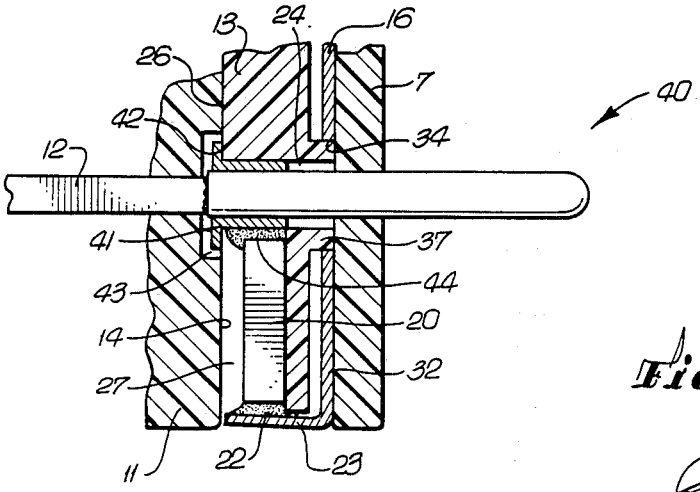
FIG. 5 is a fragmentary cross-section of a second embodiment of a multi-pin connector in accordance with the present invention.
Figure 6:
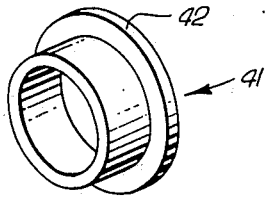
FIG. 6 is a perspective of an eyelet utilized in the embodiment of FIG. 5.

Referring next to FIG. 5, a fragmentary cross-sectional portion of a first alternate embodiment of a multiple pin connector in accordance with the present invention is indicated generally at 40. In common with the preferred embodiment described above, the multiple pin connector 40, when assembled, provides for a plurality of pins 12 passing through holes formed in a pin-support body 11, a filter block 13, a ground plane 16, and a dielectric retaining block 17. However, in contrast to the preferred embodiment, the multiple pin connector 40 includes an eyelet 41, formed of a conductive material as a substantially right circular angular cylinder, having an outer diameter substantially equivalent to the inner diameter of the hole 24 formed through the filter block 13 and an inner diameter frictionally matching the diameter of the pin 12. The axial extent of the eyelet 41 should be sufficient to extend from the surface 26 of the filter block 13 in assembled contact with the pin-support body 11 to beyond the depth of the recess 27 holding a chip capacitor 20, without reaching or contacting the ground plane 16. A flange 42 may be formed on one end of the cylinder forming the eyelet 41 such that the eyelet 41 may be properly positioned, during assembly within the hole 24 through the filter block 13 by abutting the flange 42 against the surface 26 of the filter block 13. A cavity 43 may be formed in the first surface 14 of the pin-support body 11 at the placement position of each of the pins 12, said cavity 43 accepting the flange 42 of the eyelet 41. Further detail of the construction of the eyelet 41 may be observed by reference to FIG. 6.

Each of the pins 12 in the multiple pin connector 40 has a chip capacitor 20 associated therewith. Each chip capacitor 20 is placed within its respective recess 27 within the filter block 13 such that a first electrical terminal is coupled to a flange 23 of the ground plane 16 by a solder bead 22 while the other electrical terminal of the chip capacitor 20 is electrically coupled to the outerdiametric surface of the eyelet 41 by a solder bead 44.

Figure 7:
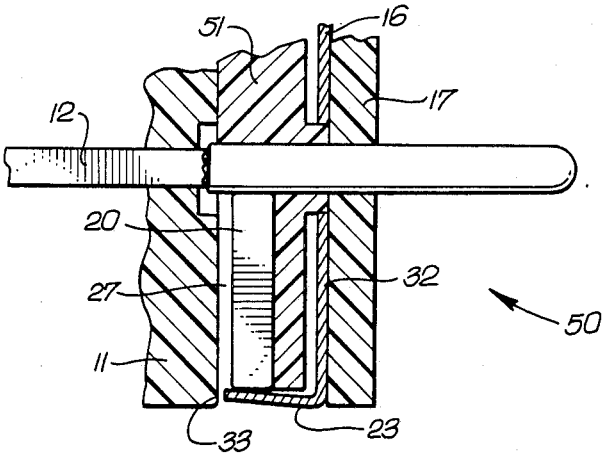
FIG. 7 is a fragmentary cross-section of a third embodiment of a multi-pin connector in accordance with the present invention.

Referring next to FIG. 7, a partial cross-sectional portion of a second alternate embodiment of a multiple pin connector in accordance with the present invention is indicated generally at 50. In common with the preferred embodiment, the multiple pin connector 50 is constructed such that a plurality of pins 12 are positioned to extend through holes formed through a pin-support body 11, a filter block 51, a ground plane 16 and a dielectric retaining block 17. The filter block 51 utilized in forming the multiple pin connector 50 differs from the filter block 13, described and illustrated with respect to FIGS. 2 and 5, in that the holes therethrough accepting the pins 12 are constrained to have an internal diameter substantially equal to the diameter of the pins 12. Thus, each pin 12 is in frictional contact with the dielectric material forming each of the pin-support body 11, the filter block 51, and the dielectric retaining block 17. Each pin 12 has a recess 27 associated therewith, as is described with respect to the preferred embodiment. A chip capacitor 20 is placed within each recess 27 such that a first electrical terminal of the chip capacitor 20 is in direct physical contact with a flange 23 of the ground plane 16 while the other electrical terminal of the chip capacitor 20 is in direct physical contact with a surface of the pin 12 passing through the associated hole. Referring briefly to FIG. 3, it may be observed that the flanges 23 formed on the ground plane 16 are bent with respect to the web 32 such that angles of less than ninety degrees are formed between the web 32 and each of the flanges 23. Referring again to FIG. 7, the chip capacitor 20 is held in position by a spring action of the flange 23, acting as a result of its degree of bending to an acute angle, to produce forces acting on the chip capacitor 20. In assembly of the multiple pin connector 50, the pin 12 is first appropriately inserted through its hole in the filter block 51 and the ground plane 16, then the flange 23 is bent downwardly of FIG. 7 so that the chip capacitor 20 may be placed between the inner surface of the flange 23 and the pin 12. When the flange 23 of the ground plane 16 is released, the flange assumes its illustrated acute angle position, thereby producing the forces retaining the chip capacitor within the recess 27 and in the appropriate electrical contact between the pin 12 and the flange 23.

While the invention has been particularly described in reference to a preferred embodiment and two alternate embodiments thereof, it will be understood by those skilled in the art that changes in form and detail may be made without departing from the spirit and scope of the invention. For example, this disclosure shows a twenty-five pin connector, however, any number of pins may be used and in any configuration or size which may be desired to mate with other plug-and-socket designs.

I claim:

1. An electrical connector assembly comprising:

a plurality of pins, a ground plane, said ground plane provided with a plurality of cavities corresponding in number to said plurality of pins, each of said cavities circumferentially surrounding a corresponding one of said pins, a plurality of filter elements, each of said filter elements being in non-circumferential relationship with an associated pin, each of said filter elements having a first electrical terminal and a second electrical terminal, said first electrical terminal of each one of said filter elements being in electrical contact with an associated pin, and said second electrical terminal of each one of said filter elements being in electrical contact with a common surface of said ground plane.

2. A device as in claim 1 wherein the longitudinal axes of said pins are substantially in alignment and said common surface of said ground plane is substantially parallel to said axes.

3. A device as in claim 2 wherein said common surface is biased toward said pins, whereby said filter elements are retained in position by said biasing.

4. A device as in claim 1 further comprising:

a filter block provided with a plurality of cavities corresponding in number to said plurality of pins, each one of said filter block cavities circumferentially surrounding one of said pins.

5. A device as in claim 4 wherein said filter block includes:

a plurality of recesses, each one of said recesses being associated with a corresponding filter block cavity, said recesses being configured to accept one of said filter elements.

6. A device as in claim 1 further comprising:

a substantially cylindrical conductive eyelet interposed between at least one of said pins and a corresponding filter element, the outer circumference of said eyelet being in electrical contact with said first terminal of said filter element, and the inner circumferential surface of said eyelet being in electrical contact with said pin.

7. An electrical connector assembly comprising:

a plurality of pins, a ground plane provided with a plurality of cavities corresponding in number to said plurality of pins, each one of said cavities circumferentially surrounding the corresponding one of said pins, said ground plane having at least one electrically conductive substantially planar surface, a plurality of filter elements, each of said filter elements being in non-circumferential relationship with an associated pin, each one of said filter elements having a first electrical terminal and a second electrical terminal, each one of said filter elements having said first electrical terminal in electrical contact with an associated one of said pins, said second terminal of each of said filter elements being in electrical contact with said electrically conductive substantially planar surface.

8. An electric connector assembly comprising:

a plurality of pins;

a ground element having a corresponding plurality of apertures, each of said apertures associated with one of said pins; and a filter element associated with at least one of said pins, said filter element being in non-circumferential relationship with said associated pin, said filter element having a first exterior edge electrically contacting said associated pin and a second exterior edge electrically contacting said ground element.

9. A device as in claim 8 wherein said filter element is positioned between said associated pin and at least a portion of said ground element.

* * * * *